United States Patent [19]

Moessinger et al.

[11] Patent Number: 4,529,015

[45] Date of Patent: Jul. 16, 1985

[54] DEVICE DESIGNED TO HELP THE INSERTION OF A WEFT YARN IN A WEAVING LOOM

[75] Inventors: Albert Moessinger, Epalinges, Switzerland; Guy Gosciniak, Illfurth; Joël Angebault, Riedisheim, both of France

[73] Assignee: Societe Alsacienne de Construction de Material Textile, France

[21] Appl. No.: 538,521

[22] Filed: Oct. 3, 1983

[30] Foreign Application Priority Data

Oct. 14, 1982 [FR] France ..... 82 17422

[51] Int. Cl.[3] ..... D03D 47/30

[52] U.S. Cl. ..... 139/435; 139/192

[58] Field of Search ..... 139/435, 192; 226/97

[56] References Cited

U.S. PATENT DOCUMENTS

| | | | |
|---|---|---|---|
| 2,705,977 | 4/1955 | Matthews | 139/192 |
| 3,139,118 | 6/1964 | Svaty et al. | 139/435 |
| 4,031,926 | 6/1977 | Zollinger et al. | 139/435 |

FOREIGN PATENT DOCUMENTS

| | | | |
|---|---|---|---|
| 0039741 | 11/1981 | European Pat. Off. | 139/435 |
| WO80/00087 | 1/1980 | PCT Int'l Appl. | 139/435 |
| 623620 | 6/1981 | Switzerland | 139/435 |

*Primary Examiner*—Henry S. Jaudon

*Attorney, Agent, or Firm*—Parkhurst & Oliff

[57] ABSTRACT

A device adapted to be introduced into the shed of a weaving loom. The device is designed to facilitate insertion of a weft by an air stream. The device has a plurality of leaves which are spaced apart to allow the passage of the warp yarns. The leaves are placed in front of the reed and are provided with a recess, which recess is situated opposite the teeth. A portion of the reed, opposite to the recess, has a sharp-edged profile while the remaining portion has a round and smooth edged profile.

5 Claims, 4 Drawing Figures

DEVICE DESIGNED TO HELP THE INSERTION OF A WEFT YARN IN A WEAVING LOOM

Figure 1:
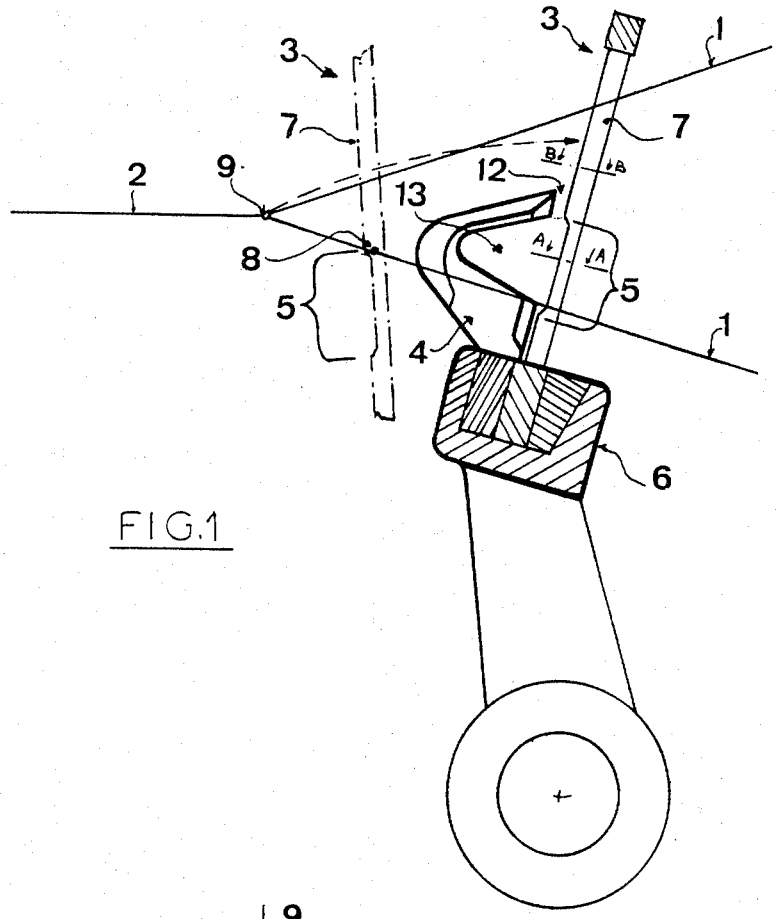

The present invention relates to an improvement in weaving looms whereby the insertion of a weft yarn is, at least partly, achieved by heaving an air stream on the weft inside the shed.

In this type of loom one of the main problems for the technicians to solve, especially considering the increased width of current looms which now reaches over three meters, has been that of channelling the air stream inside the shed.

The solution, generally adopted, to overcome this problem comprises, as described for example in French Patent No. 1 196 635 (corresponding to U.S. Application No. 3 139 118) in channelling the air stream inside the shed by forming a guiding channel with leaves comprising an internal orifice. The leaves are spaced apart to allow the passage of the warp yarns between them. The orifice cross-section is aligned in such a way that the channel is as closed up as possible. A small outlet at the periphery to extracting extract the weft before it is pressed into the cloth by the action of the reed.

The orifices of the leaves are preferably slightly conical in order to help the air flow inside the channel.

The solution has made it possible to increase the serviceable width of weaving looms using air streams, which width can reach over three meters, by providing all along said channel a number of intermediate nozzles blowing in extra air, to replace any air loss between the leaves.

However, the use of such the leaves to channel the air flow and to help the insertion of the weft into the shed, has been found to have a great disadvantage in that it has caused an increase in the size of the shed and of the stroke of the reed, these parameters are dependent on the space occupied by the leaves. Furthermore, it is well-known that as a consequence of such displacements the loom speed is reduced and, the warp yarns are subjected to damaging mechanical strains i.e., (frictions, stretching), etc.

An improved device has now been found and it is the object of the present invention, to overcome the aforesaid disadvantages and to provide a device which can be produced industrially and with greater accuracy.

The present invention therefore generally relates to a device hereinafter ("confiner"), which is designed to be temporarily introduced into the shed of a weaving loom, in synchronism with the displacements of the reed, to channel an air stream to facilitate the insertion of 9 weft. The confiner allows the passage of the warp yarns and the emerging of the weft after insertion.

The device according to the invention is characterized by the fact that it comprises, in combination:

- on the one hand, a plurality of spaced apart leaves permitting the passage of the warp yarns, the leaves are placed in front of the reed and present a recess of which the open part is situated opposite the reed, the recess having convergent edges;
- and on the other hand, a portion of the length of the reed teeth which, faces the open part of the leaves, has a sharp edged profile. The remaining portion of the reed has a round and smooth profile.

The sharp-angled profile of the reed teeth is preferably obtained by placing the side of the tooth which faces the opening of the leaves at an angle, preferably less than 5°, from the axis of the confiner (i.e. from the direction of insertion of the weft). This causes the air stream to bounce on the reed inside the shed instead of being absorbed by it as is normally the tendency with such a member.

According to a preferred embodiment of the invention, the edges of the reed teeth in the sharp-angled area are bevelled, at least close to the selvedge of the cloth, in order to prevent the yarns form wearing. Such bevelled edges, spread over a width of about 1 mm, and form an angle of 15° with the length of the cloth, thus preventing any abnormal wearing out of the yarns.

Figure 2:
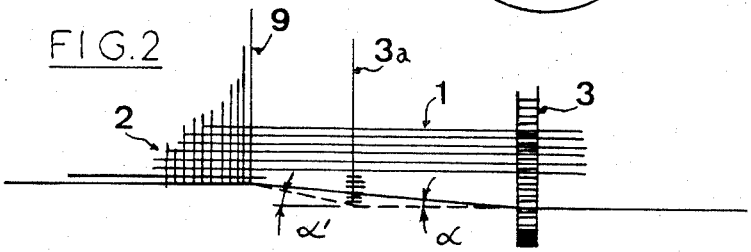
Figure 3:
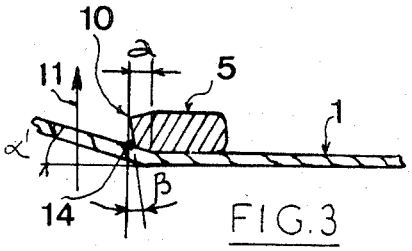
Figure 4:
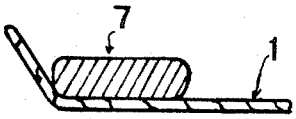

The invention will be more easily understood by reading the following description, with reference to the accompanying drawings in which:

- FIG. 1 is a diagrammatical side view of a device according to the invention;
- FIG. 2 is a diagrammatical plan view showing the deviation imposed on the warp yarns on the edges of the cloth when the reed moves;
- FIGS. 3 and 4 are respectively sections along axes AA and BB of FIG. 1 showing the cross-section of the reed tooth, first in the part where the air stream is confined, and second, outside said part.

As illustrated in FIG. 1, the shed inside which the weft yarn is inserted during a weaving operation, is made of two warp layers (1) joining up on the fell (9) of the cloth (2) and by the reed (3).

It is well known to use as a system, currently termed a "confiner", in looms using an air stream to help or ensure the insert of the weft which is designed to channel the air stream inside the shed and to be temporarily introduced in the shed in synchronism with the movements of the reed (3).

The confiner system, according to the invention, comprises, on the one hand, by a plurality of leaves (4) and, on the other hand, by a part (5) of the reed. Due to the special design of these two elements, it is possible to obtain a channel (13) inside which the weft is thrown. The channel can direct the air stream in helping to insert the weft yarns. The leaves (4) are provided with a channel (13) of which the open part is situated opposite the part (5) of the reed. In the illustrated example, the recess (13) is substantially V-shaped and its surface confining the air stream is slightly conical, forming a sharp angle with its sides and thus helping the air flow. In part (5), the reed teeth have a sharp edge. The other parts of said teeth, in particular the upper part (7), is rounded and smooth.

An opening (12) is provided between the reed and the upper part of the leaves (4) to allow the weft to emerge after insertion. The rotating point of the batten (6) supporting the reed (3) and as the leaves (4) is selected in such a way that the leaves (4) pass under the cloth (2) when the weft yarns are pressed in. Since only portion (5) is sharp-edged, it will be the rounded part (7) of the reed teeth which will strike, thus preventing any damage to the warp yarns and also any deterioration of the angles (10) provided in part (5).

Indeed, as clearly shown in FIG. 1, as reed (3) is illustrated, first in block lines in its retracted position, and second, in dash and dotted lines in its advanced position for the beating-up operation. In the most disadvantageous case, namely when reed (3) moves with the shed open, the sharp-angled part (5) rubs only against the warp yarns as far as point (8), whereas between points (8) and (9), only the normal part of the reed, namely the rounded- and smooth-edged part, remains in contact with the yarns.

The structure of the reed showing parts (5) and (7), is clearly illustrated in FIGS. 3 and 4.

For part (5) (FIG. 3), each tooth of the read has a sharp edge, namely face (14) of the tooth, situated opposite the opening (13) of the leaf (4) which forms an angle $\beta$ preferably less than 5° with the axis (11) of the confiner (i.e. with the direction in which the weft is thrown). Thus, the teeth of the reed reflect the air stream instead of absorbing it. In addition, and in particular on the selvedges, as illustrated in FIG. 2, the direction of the warp yarns is sometimes disturbed. For example, the yarn may be slightly offset when the side temples do not act correctly. In this case, the yarn (1) makes a slight angle $\alpha$ between its insertion and exit from the reed (3). As the reed advances towards fell (9) (position 3*a* in FIG. 2), the angle increases. Consequently, when the sharp-angled part (5) emerges from the shed, the angle $\alpha'$ formed by the yarns must be less than the angle formed by the bevelled part provided on the width a. An angle $\alpha'$ of about 15° over a, width a less than 1 mm, will prevent any abnormal wear of the yarns.

Because of the design of the profile of the reed in part (5), it is possible not only to obtain a good channelling of the air stream but also to avoid any premature wear of the warp yarns.

On the contrary, in part (7) of the reed (FIG. 4) the teeth have a rounded and smooth profile. The weft introduced against the formed cloth is gripped in that part.

The device, according to the invention, gives not only the possibility to of obtaining a very good channelling of the air stream, which will help the insertion of the weft into the shed, it also permits a relatively small stroke of the batten due to the fact that the weft-confining channel is closer to the reed than when it is solely composed of leaves.

In addition, the device is very easy to produce industrially as the machining of sharp edges on the part (5) and of the leaves (4) is performed according to modern techniques which are easily adaptable to existing installations for producing the conventional reeds. For example, the sharp edges of the reed in part (5) of the reed teeth are obtained by fitting a laser beam system on the conventional machines. The system spot-machining the sharp angles on each individual tooth on the teeth-feeding strip as this is introduced in the reed being formed.

The outlet (12) through which the weft emerges after its insertion, can be obtained either by allowing a small gap between the upper part of the leaf (4) and the front of the reed (3), or by pivoting the leaves (4) on the batten (6) in a manner known. Therefore, when the weft yarn is inserted, the leaves (4) and the reed (3) are movable with respect to each other obtaining a minimum opening (12), thus preventing any unwanted leak of air.

Such a device can be used either for channelling the air stream produced by a single nozzle to insert the weft through the whole width of the cloth, or in looms working with a series of nozzles distributed throughout the width of the shed, or else in combination with a system whereby the weft is inserted by inertia with the addition of one or more auxiliary nozzles to facilitate straightening of the weft. It is also possible to have the leaves with a different division and thickness from the reed.

What we claim is:

1. A device adapted to be temporarily introduced into the shed of a weaving loom in synchronism with the displacements of reed teeth and designed to channel an air stream to facilitate the insertion of a weft, said device allowing passage of the warp yarns and the emerging of the weft after its insertion in order to effect the beating, comprising:

a plurality of spaced apart leaves permitting the passage of the warp yarns, said leaves being placed in front of the reed and presenting a recess of which the open part is situated opposite said reed teeth, said recess having convergent edges;

wherein portions of the length of the reed teeth facing the open part of said leaves have sharply edged profiles, the remaining portions of the reed teeth having rounded and smooth profiles.

2. A device as recited in claim 1, wherein said recess is substantially V-shaped.

3. A device as recited in claim 1, wherein said sharply edged profile of each tooth in a part situated opposite to said recess forms an angle which is less than about 5° with respect to the direction into which the weft unwinds.

4. A device as recited in claim 1, wherein an edge of side faces of each said tooth adjacent to said sharp edges is bevelled over a width which is less than about 1 mm. forming an angle of less than about 15°.

5. A device as recited in claim 1, wherein a pivoting center of a batten supporting said reed and said leaves is selected so that said leaves pass under a cloth when the weft is pressed in, the pressing-in being carried out over said rounded profile portion of said teeth.

* * * * *